United States Patent [19]

Sarno

[11] 4,037,591

[45] July 26, 1977

[54] BATH TUB THERAPEUTIC PAD

[76] Inventor: Jay J. Sarno, 2880 Las Vegas Blvd. South, Las Vegas, Nev. 89109

[21] Appl. No.: 702,288

[22] Filed: July 2, 1976

[51] Int. Cl.[2] ..... A61H 1/00

[52] U.S. Cl. ..... 128/33; 128/65; 4/185 R

[58] Field of Search ..... 128/24 R, 33, 65, 66; 4/185 R, 185 HB, 185 S

[56] References Cited

U.S. PATENT DOCUMENTS

| | | | |
|---|---|---|---|
| 2,483,077 | 9/1949 | Walsh | 4/185 S |
| 2,582,439 | 1/1952 | Kavanagh | 4/185 S |
| 3,253,293 | 5/1966 | George et al. | 4/185 R |
| 4,010,498 | 3/1977 | Jablonski | 4/185 R |

*Primary Examiner*—Lawrence W. Trapp
*Attorney, Agent, or Firm*—Herbert C. Schulze

[57] ABSTRACT

A pad designed for therapeutic uses in bath tubs, comprising a multiplicity of resilient, and vibrant, pad elements encased in a sanitary water-proof covering, with means for holding the same in contact with the bottom and back of a bath tub when filled with water.

9 Claims, 9 Drawing Figures

BATH TUB THERAPEUTIC PAD

CROSS REFERENCE TO RELATED PATENT APPLICATIONS

This application is not related to any patent applications filed by me.

BACKGROUND OF THE INVENTION

1. Field of the Invention

This invention is in the general field of therapeutic bath tub devices, and more particularly relates to a resilient and vibrant pad upon which one may rest in a bath tub, particularly for therapeutic uses, in combination with circulating and aerated water.

2. Description of the Prior Art

There have been attempts in the past to provide seats, or the like, such as consisting of canvas straps hung over the edge of bath tubs or stools placed within bath tubs, for the purpose of maintaining a bath tub user in an elevated or semi-suspended position.

There has not been prior art in a vibrant and resilient pad encased in a waterproof covering for sanitary purposes, with the ability to adhere to the lower surface of the tub when filled with water, whether occupied by the user or not.

SUMMARY OF THE INVENTION

Many persons spend extended periods of time in a bath tub for reasons of therapeutic purposes, many times utilizing devices which circulate water within the tub, under high pressure, frequently high temperatures, and quite frequently aerated. The therapeutic effects are well known and understood.

A problem with such treatment is that the surface of a bath tub upon which the user is resting is normally hard plastic, porcelain enamel, or the like, which becomes uncomfortable, and in the case of persons with certain types of skin ailments, may actually be irritating and harmful.

In investigation of this problem, I have found from time to time canvas slings and the like have been used to attempt to alleviate the problem. Occasionally, in the study of this situation, I have used various types of resilient materials for a resting surface, and I have discovered difficulty with such items, due to their tendency to float upward when the tub is filled with water, and particularly when it is disturbed by circulating currents within the tub itself.

I have also determined that most attempts to provide such a device have been ineffective due to the rapid deterioration and difficulty of cleaning of ordinary materials suitable for such an attempt.

As a result of my studies in this field, I have devised and developed a unique segmented pad arrangement, incorporating appropriate means for causing the same to adhere to the bottom of the tub, at the same time, providing for easy removal for purposes of cleaning, or, where, for some reason, the pad is not desired.

It is possible, I have discovered hermetically to seal appropriate resilient and vibrant pad segments within a totally waterproof covering, with means attached to the covering to hold the entire unit in a fixed position within the tub, whether or not water is in the tub, and regardless of the circulation of currents of water within the tub.

I have accomplished this by fastening a number of Velcro pads to the basic resting pad, with matching Velcro pads having self-adhering material on the reverse, so positioned as to be automatically placed in the appropriate position within the tub, after which the basic resting pad may be removed as desired and always replaced in proper position against the tub-adhering pads.

I have also discovered that it is possible to achieve somewhat the same effect by the use of appropriately weighted elements properly placed, as will be described below, as well as by use of suction cups or the like.

I have further discovered that by use of the appropriate materials and sizes and shapes, the pads can be caused to have an accentuating vibrating effect upon the body under the action of circulating and therapeutic current within the tub.

It is an object of this invention to provide a pad which may be removably held in position within a bath tub for use by individuals requiring therapeutic bath tub treatment;

Another object of this invention is to provide such a pad as described which may be placed in position within a bath tub by an unskilled person.

Another object of this invention is to provide such a pad as described, wherein the pad is vibrant and responds to circulating currents within the bath tub so as to enhance the action thereof.

The foregoing and other objects and advantages or this invention will become apparent to those skilled in the art upon reading the description of a preferred embodiment which follows, in conjunction with the accompanying drawings.

DESCRIPTION OF A PREFERRED EMBODIMENT

Figure 1:
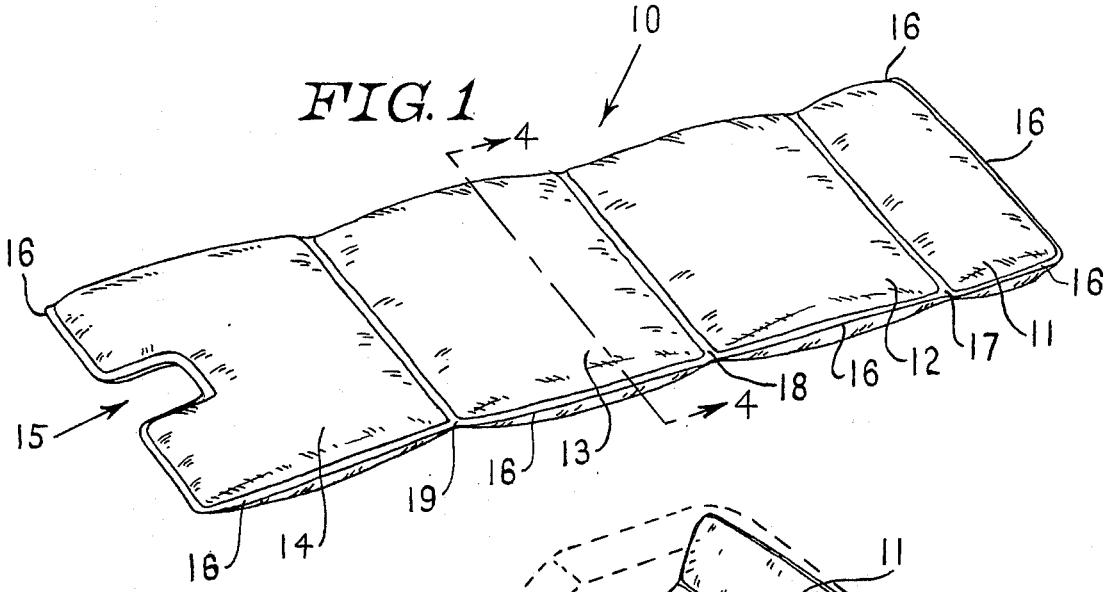
FIG. 1 is a perspective of a preferred embodiment of the pad of this invention.

FIG. 1, illustrates in perspective, a preferred embodiment of the pad constituting this invention. FIG. 1 does not, however, show specifically the means for causing the pad to adhere to a tub which is better illustrated in the subsequent figures, and particularly in FIG. 2, FIG. 4, FIG. 7, FIG. 8, and FIG. 9.

Viewing more carefully FIG. 1, it is shown that this apparatus, generally 10, consists of a series of pad elements 11, 12, 13, and 14. The exact construction of the pad elements is better shown in FIGS. 4 through 9 below. The pad elements are encased in a sanitary and water-proof material, such as vinyl, or the like, which is appropriately sealed (by heat sealing or the like) all about its edges at 16, and the individual pad elements are separated from one another by heat sealing or the like at 17, 18 and 19. The cut-out portion 15 is purposely so provided as to accommodate for the drain of a bath tub 51, as is shown more specifically in FIGS. 2 and 3.

Figure 2:
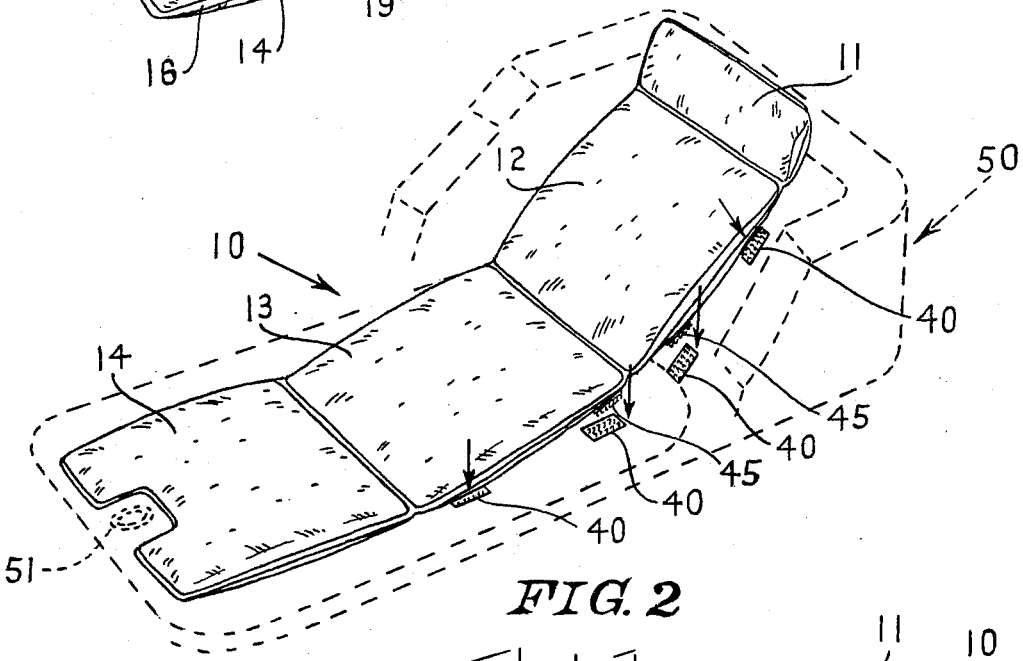
FIG. 2 is a perspective of a bath tub with the pad being applied in position.

FIG. 2 illustrates a bath tub generally 50, in phantom, and broken away. It is observed in FIG. 2 that a series of Velcro pads 40 are adhering to the surface of the tub, and matching pads 45 grip and will grip with the pads 40. There is no magic number of pads necessary, but it has been found that four Velcro pads for each of the segments of the overall bath tub pad are quite satisfactory and usable.

Figure 3:
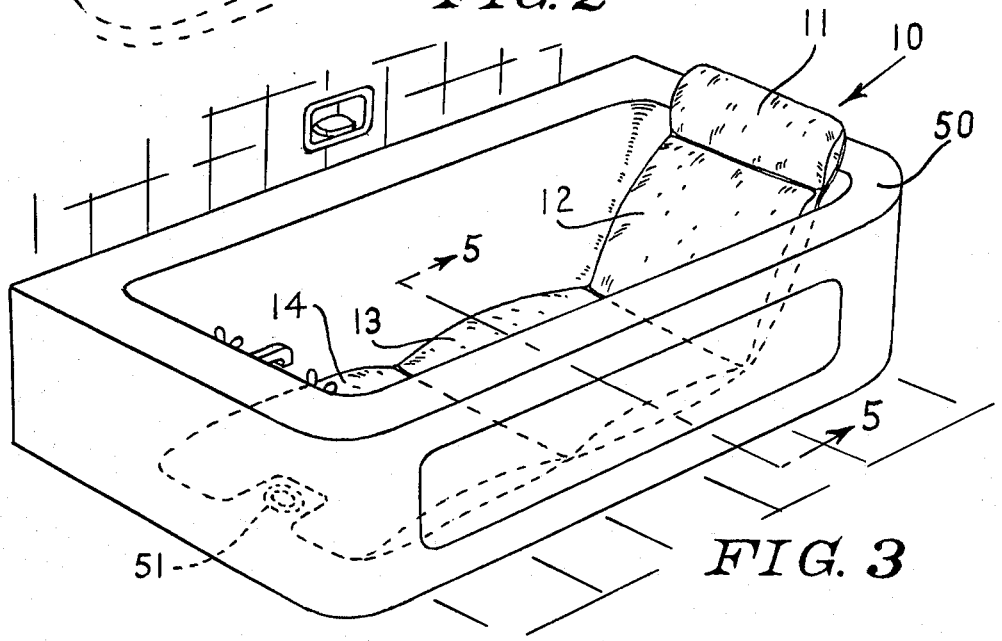
FIG. 3 is a perspective of a bath tub showing the pad of of this invention, partially in phantom.

FIG. 3 illustrates the pad of this invention 10, completely in place within a tub 50. Portions of the pad and the drain are shown in phantom.

Figure 4:
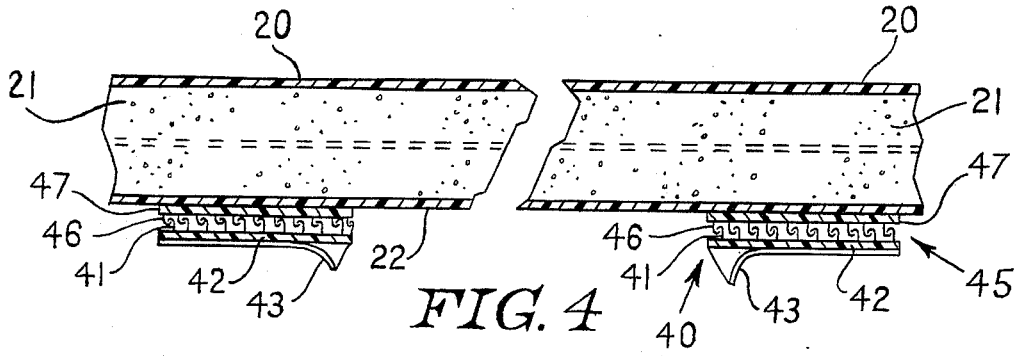
FIG. 4 is an enlarged section on 4—4 of FIG. 1.
Figure 5:
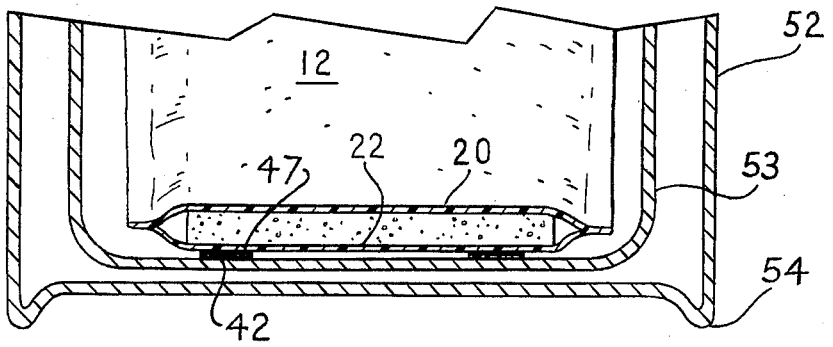
FIG. 5 is an enlarged section on 5—5 of FIG. 3.

FIG. 4 and FIG. 5 are particularly significant in showing the manner in which the overall bath tub pad of this invention is fastened by the use of the Velcro pads. FIG. 4 is a section through 4—4 of FIG. 1, and shown a resilient foam material 21 encased by the upper and lower vinyl coatings 20 and 22. Velcro pads 40 and 45 fastened together by the adhering, but separable material 41 and 46 respectively, as is known in the art, are illustrated in position upon the covering 22. The pad 45 adheres to the vinyl 22 by means of adhesive backing material 47. The pad 40 includes adhesive material 42 with a removable covering 43 as is known in the art.

As supplied, the basic bath tub pad of this invention will have a multiplicity of the matching pads 40–45. The user will then peel off the backing and protective material 43 from each pad and will then apply it in the tub in the manner shown in FIG. 2. Thereafter, the pad may be removed by the separation of the matching Velcro pad, for cleaning and the like, and replaced in position at will.

FIG. 5 shows how a pad will look in cross-section when placed in a bath tub. The particular bath tub shown here is of customary construction being a double wall ceramic or the like, having an outer wall 52, inner wall 53, and supporting edge 54.

Figure 6:
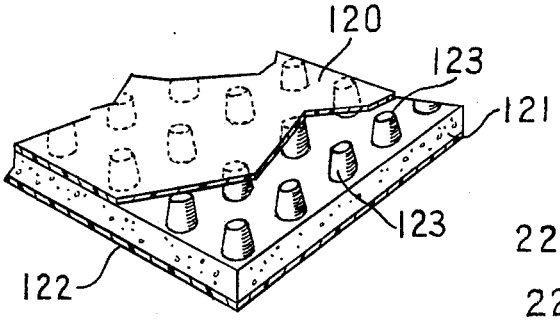
FIG. 6 is a partially sectioned, partially broken away view of an alternate pad material.

FIG. 6 is an alternate construction for the pad material heretofore shown as 21. In this particular case, the upper vinyl coating has been indicated by the reference numeral 120, the lower vinyl coating by the reference numeral 122, the basic resilient pad material of foam rubber or the like 121, with numerous upstanding form elements or the like, 123.

While the basic foam material 21 utilized is naturally resilient and will vibrate in response to the action of the user the circulating currents, in some cases the structure of FIG. 6 will further accentuate such vibrating quality.

Figure 7:
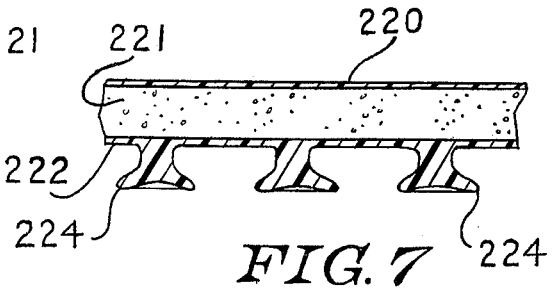
FIG. 7 is a sectional view of an alternate embodiment utilizing suction cups.

FIG. 7 illustrates, in cross-section, another alternate embodiment of the basic pad material. In this case, the upper vinyl coating material 220 and the lower vinyl coating material 222 are shown, with the inserted pad material 221. A unique construction is illustrated in this particular view, wherein a number of vinyl suction cups 224 have been formed as an integral part of the lower vinyl coating 222. Alternately, it might occur to some individuals, to utilize commercially available rubber suction cups or the like, and fasten them to a lower coating of vinyl with appropriate adhesive. The integrally formed suction cups are deemed to be an important advance in the art, and a sub-invention in themselves.

Figure 8:
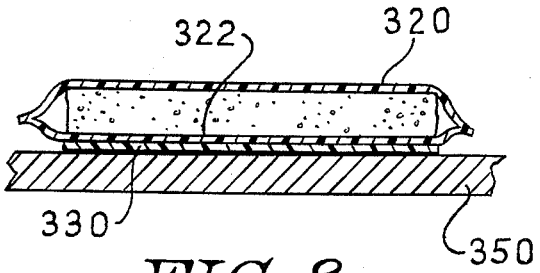
FIG. 8 is a partial sectional view of the bottom of a bath tub showing an alternate means for adhering the pad to the tub.

In FIG. 8, a pad element has been shown in cross-section with upper and lower coatings 320 and 322. A bath tub surface 350 is shown, and a complete coat of adhesive 330 totally adhering the pad to the tub is illustrated. For permanent installation in the bath tub, this method could be utilized to install a vibrant and responsive pad. In general, however, the removable pads are deemed more desirable due to the ultimate potential of wear and replacement.

Figure 9:
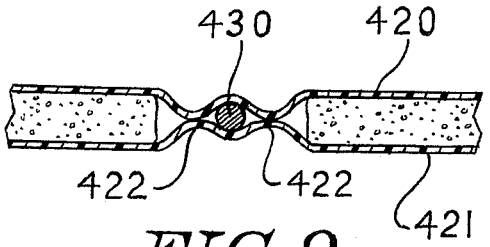
FIG. 9 is a partial sectional view illustrating another alternate embodiment of a means to hold the pad in a tub.

For those who do not desire to utilize a pad having any type of adhering elements, such as shown in FIGS. 4 and 7, it is feasible, however less effective, to provide a pad of the basic nature described above, wherein a weighted element is appropriately placed in conjunction with individual pads to hold them down within the water. The weighted elements may be appropriately placed and most conveniently as shown in FIG. 9 between the vibrant pad elements constituting the overall pad. FIG. 9 shows the upper and lower vinyl coatings as 420 and 422 with the pad 421 in position. A weight, such as a metallic bar 430, is placed between the pads, which are then appropriately sealed at 422 on each side. This construction will be understood by those skilled in the art, as well as the other construction herein described after this specification has been read in conjunction with the drawings.

While the embodiments of this invention specifically shown and described are fully capable of achieving the objects and advantages desired, it is to be understood that such embodiments are for purposes of illustration only, and not for purposes of limitation.

I claim:

1. A therapeutic pad for use in a bath tub comprising: (1) a multiplicity of resilient and vibrant pad elements, one of said pad elements being of such configuration as to provide an opening therein to accommodate, and partially surround, the bath tub drain area; (2) a water-proof covering completely encasing said pad elements; (3) means joining said pad elements into an elongated series of pad elements; and (4) means to cause said pad elements to adhere to a bath tub surface when water is in said bath tub.

2. The apparatus of claim 1 wherein the individual pad elements comprise a resilient foam material responsive to vibrating forces.

3. The apparatus of claim 2 wherein said individual pad elements are covered with vinyl material.

4. The apparatus of claim 3 wherein matching pairs of self-adhering, but separable material, are used as the means to hold said bath tub pad in contact with the tub surface, and wherein one-half of each set of matching pairs adheres to the bath tub surface permanently and the other half adheres to the under side of the pad permanently.

5. The apparatus of claim 3 wherein suction cups adhering to the under side of said bath tub pad elements are utilized as the means by which said pad elements are kept in contact with the bath tub surface when filled with water.

6. The apparatus of claim 5 wherein the said suction cup devices are integrally formed with one surface of the water-proof covering.

7. The apparatus of claim 3 wherein the means to hold said bath tub pad elements in contact with the bath tub surface comprises a layer of adhesive material bonding the lower surface of the water-proof covering of the pad elements to the surface of the bath tub.

8. The apparatus of claim 3 wherein a multiplicity of weights are used as a means for holding said bath tub pad elements in contact with the bath tub surface when filled with water.

9. The apparatus of claim 3 wherein the resilient pad elements include a multiplicity of separated protrusions formed on an under-lying pad.

* * * * *